US009532412B2

(12) United States Patent
Kim et al.

(10) Patent No.: US 9,532,412 B2
(45) Date of Patent: Dec. 27, 2016

(54) LIGHTING APPARATUS CAPABLE OF REDUCING FLICKER

(71) Applicant: SILICON WORKS CO., LTD., Daejeon-si (KR)

(72) Inventors: Yong Geun Kim, Suwon-si (KR); Gyeong Sik Mun, Daejeon-si (KR); Ki Chul An, Daegu-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 0 days.

(21) Appl. No.: 14/883,941

(22) Filed: Oct. 15, 2015

(65) Prior Publication Data

US 2016/0119985 A1 Apr. 28, 2016

(30) Foreign Application Priority Data

Oct. 22, 2014 (KR) ..... 10-2014-0143233

(51) Int. Cl.
*H05B 33/08* (2006.01)

(52) U.S. Cl.
CPC ..... *H05B 33/0809* (2013.01); *H05B 33/0827* (2013.01)

(58) Field of Classification Search
None
See application file for complete search history.

(56) References Cited

U.S. PATENT DOCUMENTS

2012/0081009 A1* 4/2012 Shteynberg ..... H05B 33/083 315/122

FOREIGN PATENT DOCUMENTS

| | | | | |
|---|---|---|---|---|
| JP | 5639389 | | 10/2014 | |
| KR | 2014133262 A | * | 5/2013 | ..... H05B 37/02 |
| KR | 10-2013-0104800 | | 9/2013 | |
| KR | 10-1414902 | | 7/2014 | |
| KR | 10-1435852 | | 8/2014 | |
| KR | 10-2014-0107839 | | 9/2014 | |
| KR | 10-2015-0000976 | | 1/2015 | |

* cited by examiner

*Primary Examiner* — Dedei K Hammond
(74) *Attorney, Agent, or Firm* — Kile Park Reed & Houtteman PLLC

(57) ABSTRACT

Disclosed is a lighting apparatus which includes LEDs and reduces flicker. The lighting apparatus may secure a charge voltage by performing a charge operation using a current corresponding to a rectified voltage equal to or more than a preset level, and compensate for the rectified voltage provided to a lighting unit including LED groups by performing a discharge operation for the charge voltage in response to the rectified voltage less than the preset level, thereby reducing flicker.

12 Claims, 10 Drawing Sheets

LIGHTING APPARATUS CAPABLE OF REDUCING FLICKER

BACKGROUND

1. Technical Field

The present disclosure relates to a lighting apparatus, and more particularly, to a lighting apparatus which includes light emitting diodes (LEDs) and is capable of reducing flicker.

2. Related Art

In order to reduce energy, a lighting apparatus is designed to use a light source which exhibits high light emission efficiency based on a small amount of energy. Representative examples of the light source used in the lighting apparatus may include an LED.

The LED is differentiated from other light sources in terms of various aspects such as energy consumption, lifetime, and light quality. Since the LED is driven by a current, a lighting apparatus using the LED as a light source requires a large number of additional circuits for current driving.

In order to solve the above-described problem, an AC direct-type lighting apparatus has been developed to provide an AC voltage to the LED. The lighting apparatus is configured to convert an AC voltage into a rectified voltage, and control the LED to emit light through a current driving operation using the rectified voltage. Since the lighting apparatus directly uses a rectified voltage without using an inductor and capacitor, the lighting apparatus has a satisfactory power factor.

The rectified voltage indicates a voltage obtained by full-wave rectifying an AC voltage through a rectifier.

Since the above-described lighting apparatus has a period in which it is turned off due to the characteristic of the rectified voltage, flicker may occur. Thus, the lighting apparatus using LEDs needs to reduce flicker through a simple circuit, the flicker occurring due to the characteristic of the rectified voltage.

SUMMARY

Various embodiments are directed to a lighting apparatus capable of reducing flicker using a circuit which charges and discharges a capacitor with a rectified voltage and includes a small number of parts.

Also, various embodiments are directed to a lighting apparatus capable of reducing flicker by performing a charge and discharge operation for a rectified voltage on LEDs having a relatively high light intensity, and reducing flicker by performing a charge and discharge operation on LEDs having a relatively low light intensity.

Also, various embodiments are directed to a lighting apparatus capable of improving a power factor by controlling a charge operation to follow a current of a current path in response to light emission of LEDs having a relatively low light intensity.

In an embodiment, there is provided a lighting apparatus which uses a rectified voltage. The lighting apparatus may include: a lighting unit including a plurality of LEDs configured to emit light in response to the rectified voltage and divided into a plurality of LED groups; a flicker control circuit configured to secure a charge voltage by performing a first charge operation based on a magnitude-limited current using the rectified voltage which is equal to or more than a first level and provided through one or more LEDs, and provide the charge voltage to an input terminal of the lighting unit through a first discharge operation, in response to the rectified voltage less than a second level lower than the first level; and a control unit configured to provide a current path for light emission of the lighting unit.

In another embodiment, there is provided a lighting apparatus which uses a rectified voltage. The lighting apparatus may include: a lighting unit including a plurality of LEDs configured to emit light in response to the rectified voltage and divided into a plurality of LED groups; a flicker control circuit configured to secure a charge voltage by performing a first charge operation using a current corresponding to the rectified voltage equal to or more than a preset level, and compensate for the rectified voltage provided to the lighting unit by performing a first discharge operation for the charge voltage in response to the rectified voltage less than the preset level; and a control unit configured to provide a current path for light emission of the lighting unit.

DETAILED DESCRIPTION

Figure 1:
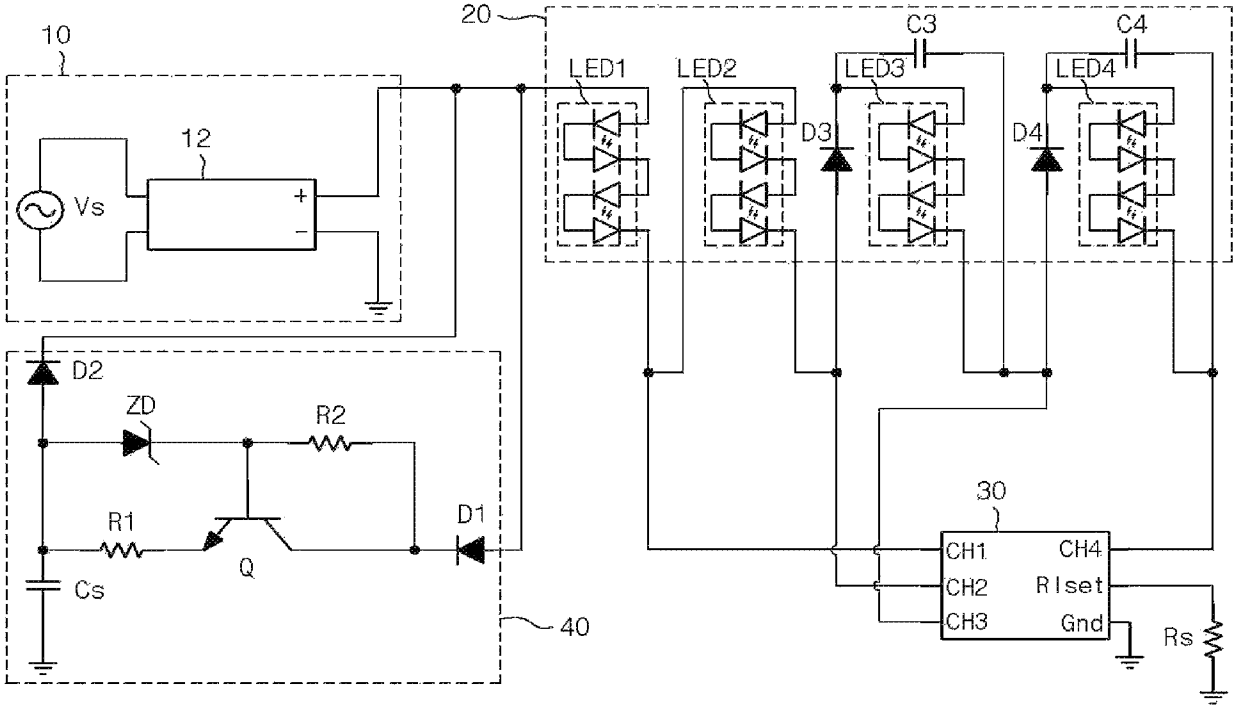
FIG. 1 is a circuit diagram illustrating a lighting apparatus in accordance with an embodiment of the present invention.

Hereafter, exemplary embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

A lighting apparatus in accordance with an embodiment of the present invention may use a light source having the light emitting characteristic of a semiconductor which converts electrical energy into light energy, and the light source having the light emitting characteristic of a semiconductor may include an LED.

The embodiments of the present invention may disclose an AC-direct type lighting apparatus as illustrated in FIG. 1. The lighting apparatus of FIG. 1 may include a light source to emit light using an AC voltage, and perform current regulation for regulating a driving current in response to light emission of the light source.

Referring to FIG. 1, the lighting apparatus in accordance with the embodiment of the present invention may include a power supply circuit 10, a lighting unit 20, a control unit 30, a current sensing resistor Rs, and a flicker control circuit 40.

The power supply circuit 10 may provide a rectified voltage, the lighting unit 20 may emit light using the rectified voltage, and the control unit 30 may perform current regulation for regulating a driving current corresponding to light emission of the lighting unit 20 and provide a current path for light emission. The current sensing resistor Rs may provide a current path, and provide a sensing voltage for the current regulation of the control unit 30. The flicker control circuit 40 may perform a charge and discharge operation for compensating for a rectified voltage, in order to reduce flicker.

The power supply circuit 10 may include a power supply Vs and a rectifier circuit 12. The power supply Vs may include a commercial AC power supply to provide AC power.

The rectifier circuit 12 may convert a negative voltage of an AC voltage into a positive voltage. That is, the rectifier circuit 12 may full-wave rectify an AC voltage having the sine-waveform of the AC power provided from the AC power supply Vs, and output the rectified voltage. The rectified voltage may have a ripple in which the voltage level rises and falls on a basis of the half cycle of the commercial AC voltage. In the embodiment of the present invention, the rise or fall of the rectified voltage may indicate a rise or fall of the ripple of the rectified voltage.

In the embodiment of the present invention, the lighting unit 20 including a light source may emit light using the rectified voltage provided from the rectifier circuit 12.

The lighting unit 20 may include a plurality of LEDs, and the plurality of LEDs may be divided into a plurality of LED groups and sequentially turned on or off. In FIG. 1, the lighting unit 20 may be divided into four LED groups LED1 to LED4. Each of the LED groups LED1 to LED4 may include one or more LEDs which are connected in series, parallel, or serial-parallel to each other. For convenience of description, FIG. 1 illustrates that the plurality of LED groups are connected in series.

The LED groups LED3 and LED4 of the lighting unit 20 may be connected to capacitors C3 and C4 serving as flicker control elements, respectively. In order to prevent a reverse current flow caused by the capacitors C3 and C4, diodes D3 and D4 may be connected in series to the input terminals of the respective LED groups LED3 and LED4.

The control unit 30 may regulate a driving current, and induce a flow of driving current in response to light emission of the lighting unit 20. For this operation, the control unit may perform current regulation for light emission of the LED groups LED1 to LED4, and provide a current path for light emission with the current sensing resistors Rs of which one ends are grounded.

In the embodiment of FIG. 1, the LED groups LED1 to LED4 of the lighting unit 20 may be sequentially turned on or off in response to rises or falls of the rectified voltage.

The control unit 30 may provide a current path for light emission, when the rectified voltage increases to sequentially reach light emission voltages of the respective LED groups LED1 to LED4.

The light emission voltage V4 for controlling the LED group LED4 to emit light may be defined as a voltage for controlling all of the LED groups LED1 to LED4 to emit light. The light emission voltage V3 for controlling the LED group LED3 to emit light may be defined as a voltage for controlling the LED groups LED1 to LED3 to emit light. The light emission voltage V2 for controlling the LED group LED2 to emit light may be defined as a voltage for controlling the LED groups LED1 to LED2 to emit light. The light emission voltage V1 for controlling the LED group LED1 to emit light may be defined as a voltage for controlling only the LED group LED1 to emit light.

The control unit 30 may receive a sensing voltage from the current sensing resistor Rs. The sensing voltage may be varied by a current path formed at a variable position within the control unit 30 according to the light emitting states of the respective LED groups in the lighting unit 20. At this time, the driving current flowing through the current sensing resistor Rs may include a current corresponding to each of the LED groups and having a limited magnitude.

The detailed configuration and operation of the control unit 30 will be described with reference to FIG. 2.

Figure 2:
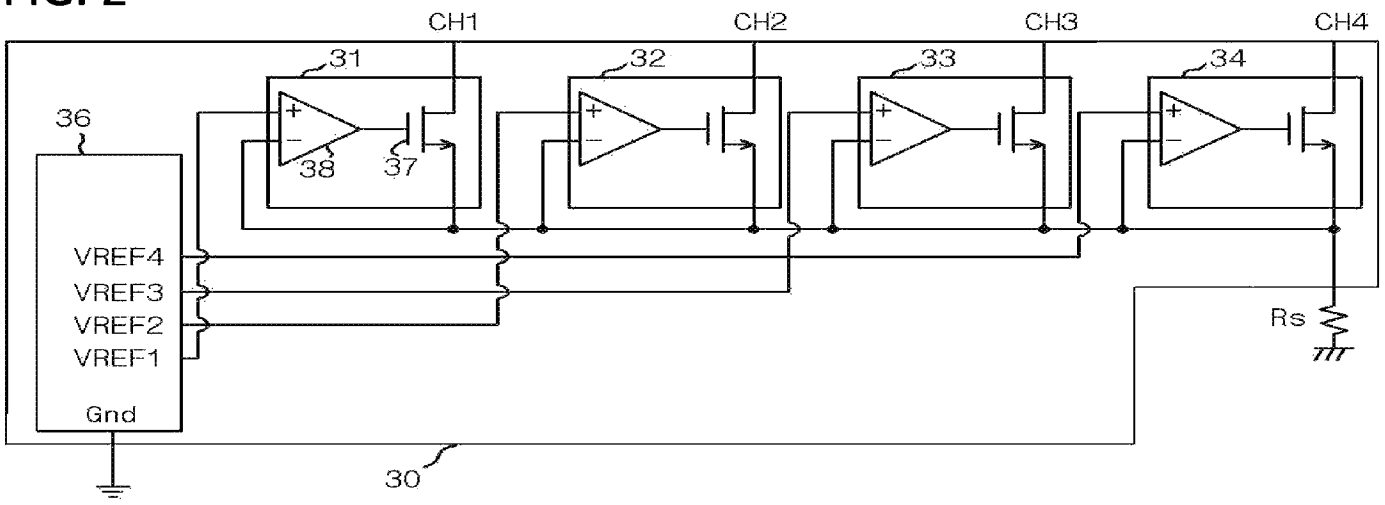
FIG. 2 is a detailed circuit diagram of a control unit of FIG. 1.

As illustrated in FIG. 2, the control unit 30 may include a plurality of switching circuits 31 to 34 and a reference voltage supply unit 36 which can be implemented as one chip. The plurality of switching circuits 31 to 34 may provide a current path for the LED groups LED1 to LED4, and the reference voltage supply unit 36 may provide reference voltages VREF1 to VREF4.

The reference voltage supply unit 36 may be configured to provide the reference voltages VREF1 to VREF4 having different levels according to a designer's intention.

The reference voltage supply unit 36 may include a plurality of resistors which are connected in series to receive a constant voltage, and output the reference voltages VREF1 to VREF4 having different levels through nodes among the resistors. In another embodiment, the reference voltage supply unit 36 may include independent voltage supply sources for providing the reference voltages VREF1 to VREF4 having different levels.

Among the reference voltages VREF1 to VREF4 having different levels, the reference voltage VREF1 may have the lowest voltage level, and the reference voltage VREF4 may have the highest voltage level.

The reference voltage VREF1 may have a level for turning off the switching circuit 31 at the point of time that the LED group LED2 emits light. More specifically, the reference voltage VREF1 may be set to a lower level than the sensing voltage which is formed in the current sensing resistor Rs in response to light emission of the LED group LED2.

The reference voltage VREF2 may have a level for turning off the switching circuit 32 at the point of time that the LED group LED3 emits light. More specifically, the reference voltage VREF2 may be set to a lower level than the sensing voltage which is formed in the current sensing resistor Rs in response to light emission of the LED group LED3.

The reference voltage VREF3 may have a level for turning off the switching circuit 33 at the point of time that the LED group LED4 emits light. More specifically, the reference voltage VREF3 may be set to a lower level than the sensing voltage which is formed in the current sensing resistor Rs in response to light emission of the LED group LED4.

The reference voltage VREF4 may be set in such a manner that a current path through the switching circuit 34 is maintained in the upper limit level region of the rectified voltage.

The switching circuits 31 to 34 may be commonly connected to the current sensing resistor Rs for providing a sensing voltage, in order to perform current regulation and form a current path.

The switching circuits 31 to 34 may compare the sensing voltage of the current sensing resistor Rs to the reference voltages VREF1 to VREF4 of the reference voltage supply unit 36, and form a selective current path for controlling the lighting unit 20 to emit light.

The switching circuits 31 to 34 of the control unit 30 may induce a flow of magnitude-limited driving current, in response to light emissions of the respective LED groups LED1 to LED4, and perform current regulation in response to sequential light emissions of the respective LED groups LED1 to LED4, such that the driving current does not exceed a preset regulated current value.

That is, each of the switching circuits 31 to 34 may not perform a current regulation operation on a driving current less than the regulated current value set thereto, but perform a current regulation operation on a driving current equal to or more than the regulated current value set therein such that the driving current does not exceed the regulated level.

Each of the switching circuits 31 to 34 may receive a higher-level reference voltage as the switching circuit is connected to an LED group remote from the position to which the rectified voltage is applied.

Each of the switching circuits 31 to 34 may include a comparator 38 and a switching element 37, and the switching element 37 may include an NMOS transistor.

The comparator 38 included in each of the switching circuits 31 to 34 may have a positive input terminal (+) configured to receive a reference voltage, a negative input terminal (−) configured to receive a sensing voltage, and an output terminal configured to output a result obtained by comparing the reference voltage and the sensing voltage.

The switching element 37 included in each of the switching circuits 31 to 34 may perform a switching operation according to the output of the corresponding comparator 38, which is applied through the gate thereof.

In order to promote understanding of the embodiment of the present invention to which the flicker control circuit 40 and the capacitors C3 and C4 serving as flicker control elements are applied, the operation of the control unit 30 in a state where the flicker control circuit 40 and the capacitors C3 and C4 serving as the flicker control elements are not applied will be described with reference to FIG. 3.

Figure 3:
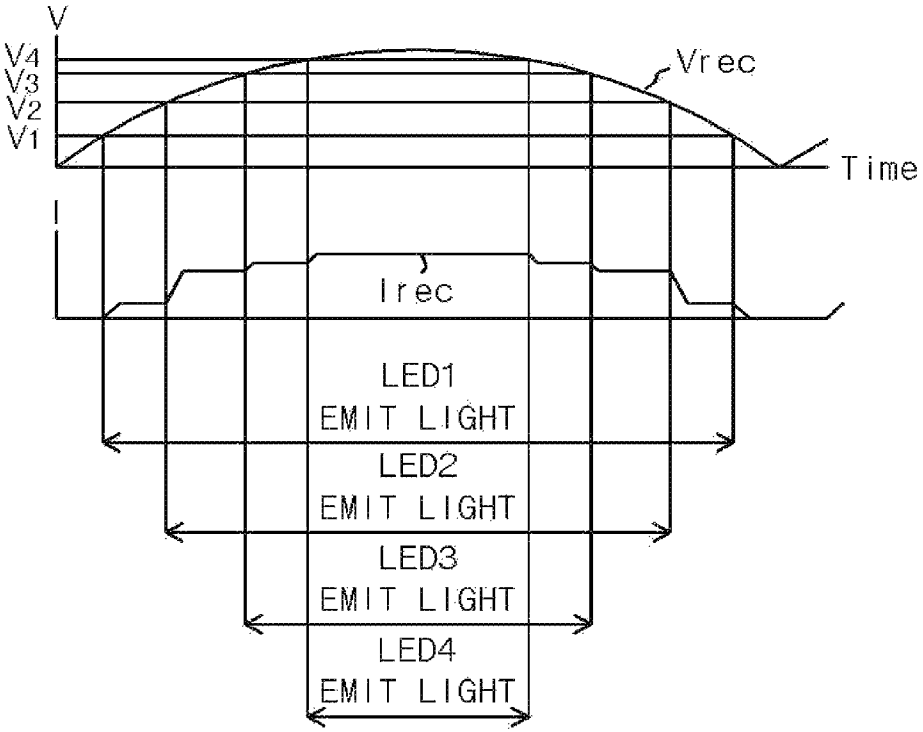
FIG. 3 is a waveform diagram for describing the operation of a general control circuit.

The rectified voltage may periodically rise and fall as illustrated in FIG. 3.

When the rectified voltage Vrec is in the initial state, the switching circuits 31 to 34 may maintain a turn-on state because the reference voltages VREF1 to VREF4 applied to the positive input terminals (+) thereof are higher than the sensing voltage of the current sensing resistor Rs, which is applied to the negative input terminals (−) thereof. At this time, the driving current Irec flowing to the switching circuit 31 may be less than the current value regulated by the switching circuit 31. Thus, the switching circuit 31 may not regulate the driving current Irec flowing therein. That is, a current regulation operation by the switching circuit 31 may not be performed.

Then, when the rectified voltage Vrec rises to reach the light emission voltage V1, the LED group LED1 of the lighting unit 20 may emit light. When the LED group LED1 emits light, the switching circuit 31 of the control unit 30 connected to the LED group LED1 may provide a current path.

When the rectified voltage Vrec reaches the light emission voltage V1 such that the LED group LED1 emits light and the current path is formed through the switching circuit 31, the level of the sensing voltage of the current sensing resistor Rs may rise. At this time, however, since the level of the sensing voltage is low, the turn-on states of the switching circuits 31 to 34 may not be changed. Furthermore, the driving current Irec flowing through the switching circuit 31 may be regulated by the current regulation operation of the switching circuit 31.

Then, the rectified voltage Vrec may rise over the light emission voltage V1. At this time, the driving current Irec flowing to the switching circuit 32 may be less than the current value regulated by the switching circuit 32. Thus, the switching circuit 32 may not regulate the driving current Irec flowing therein. That is, the current regulation operation by the switching circuit 31 may be performed, and the current regulation operation by the switching circuit 32 may not be performed.

Then, when the rectified voltage Vrec continuously rises to reach the light emission voltage V2, the LED group LED2 of the lighting unit 20 may emit light. Then, when the LED group LED2 emits light, the switching circuit 32 of the control unit 30 connected to the LED group LED2 may provide a current path. At this time, the LED group LED1 may also maintain the light emitting state.

When the rectified voltage Vrec reaches the light emission voltage V2 such that the LED group LED2 emits light and the current path is formed through the switching circuit 32, the level of the sensing voltage of the current sensing resistor Rs may rise. At this time, the sensing voltage may have a higher level than the reference voltage VREF1. Therefore, the switching element 37 of the switching circuit 31 may be turned off by the output of the comparator 38. That is, the switching circuit 31 may be turned off, and the switching circuit 32 may provide a selective current path corresponding to the light emission of the LED group LED2. At this time, the driving current Irec flowing through the switching circuit 32 may be regulated by the current regulation operation of the switching circuit 32.

Then, when the rectified voltage Vrec continuously rises to reach the light emission voltage V3, the LED group LED3 of the lighting unit 20 may emit light. When the LED group LED3 emits light, the switching circuit 33 of the control unit 30 connected to the LED group LED3 may provide a current path. At this time, the LED groups LED1 and LED2 may also maintain the light emitting state.

When the rectified voltage Vrec reaches the light emission voltage V3 such that the LED group LED3 emits light and the current path is formed through the switching circuit 33, the level of the sensing voltage of the current sensing resistor Rs may rise. At this time, the sensing voltage may have a higher level than the reference voltage VREF2. Therefore, the switching element 37 of the switching circuit 32 may be turned off by the output of the comparator 38. That is, the switching circuit 32 may be turned off, and the switching circuit 33 may provide a selective current path corresponding to the light emission of the LED group LED3. At this time, the driving current Irec flowing to the switching circuit 33 may be regulated by the current regulation operation of the switching circuit 33.

Then, when the rectified voltage Vrec reaches the light emission voltage V4, the LED group LED4 of the lighting unit 20 may emit light. When the LED group LED4 emits light, the switching circuit 34 of the control unit 30 connected to the LED group LED4 may provide a current path. At this time, the LED groups LED1 to LED3 may also maintain the light emitting state.

When the rectified voltage Vrec reaches the light emission voltage V4 such that the LED group LED4 emits light and the current path is formed through the switching circuit 34, the level of the sensing voltage of the current sensing resistor Rs may rise. At this time, the sensing voltage may have a higher level than the reference voltage VREF3. Therefore, the switching element 37 of the switching circuit 33 may be turned off by the output of the comparator 38. That is, the switching circuit 33 may be turned off, and the switching circuit 34 may provide a selective current path corresponding to the light emission of the LED group LED4. At this time, the driving current Irec flowing to the switching circuit 34 may be regulated by the current regulation operation of the switching circuit 34.

Then, the rectified voltage Vrec may rise over the light emission voltage V4. At this time, the switching circuit 34 may regulate the driving current Irec so as not to exceed the regulated level. Then, although the rectified voltage Vrec continuously rises, the switching circuit 34 may maintain the turn-on state such that the driving current Irec formed in the current sensing resistor Rs becomes a predetermined magnitude-limited current in the upper limit level region of the rectified voltage Vrec.

As described above, when the LED groups LED1 to LED4 sequentially emit light in response to the rises of the rectified voltage Vrec, the driving current Irec on the current path may rise in a stepwise manner so as to have a stepped waveform as illustrated in FIG. 3.

The control unit 30 may perform the current regulation operation as described above. Thus, the driving current Irec corresponding to light emission of each LED group may retain a constant level. When the number of LED groups to emit light increases, the level of the driving current may rise in response to the increase.

The rectified voltage Vrec may start to fall after rising to the upper limit level as described above. When the rectified voltage Vrec falls below the light emission voltage V4, the LED group LED4 of the lighting unit 20 may be turned off.

When the LED group LED4 is turned off, the lighting unit 20 may maintain the light emitting state using the LED groups LED3, LED2, and LED1. Thus, a current path may be formed by the switching circuit 33 connected to the LED group LED3.

Then, when the rectified voltage Vrec sequentially falls below the light emission voltages V3, V2, and V1, the LED groups LED3, LED2, and LED1 of the lighting unit 20 may be sequentially turned off.

As the LED groups LED3, LED2, and LED1 of the lighting unit 20 are sequentially turned off, the control unit 30 may shift and provide a selective current path formed by the switching circuits 33, 32, and 31. Furthermore, in response to the turn-off states of the LED groups LED1, LED2, and LED3, the driving current Irec on the current path may also fall in a stepwise manner so as to have a stepped waveform.

As described above, the lighting apparatus using the rectified voltage Vrec in a state where the flicker control circuit 40 and the capacitors C3 and C4 serving as flicker control elements are not applied may be turned off when the rectified voltage Vrec is lower than the light emission voltage V1 of the LED group LED1. Thus, flicker may occur.

Figure 4:
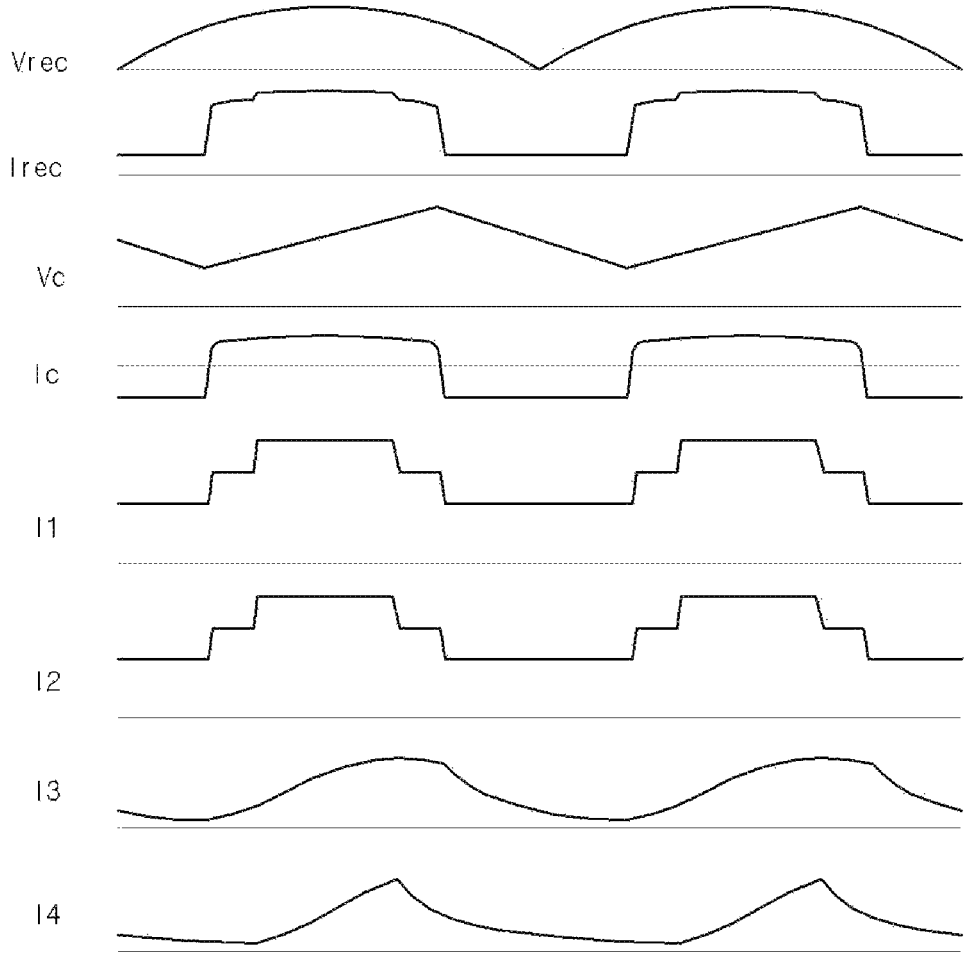
FIG. 4 is a waveform diagram for describing the operation of the lighting apparatus in accordance with the embodiment of FIG. 1.

The flicker may be reduced by the operations of the flicker control circuit 40 and the capacitors C3 and C4 which are applied to the embodiment of the present invention. This operation will be described with reference to FIG. 4. In FIG. 4, Vrec represents a rectified voltage outputted from the rectifier circuit 12, Irec represents a driving current provided from the lighting unit 20, Vc and Ic represent a charge voltage and a charge current which are stored in the capacitor Cs of the flicker control circuit 40, and I1 to I4 represent driving currents flowing through the respective LED groups LED1 to LED4.

The flicker control circuit 40 of FIG. 1 may secure the charge voltage Vc by performing a first charge operation using a magnitude-limited current based on the rectified voltage Vrec equal to or more than a preset level, and perform a first discharge operation for the charge voltage Vc in response to the rectified voltage Vrec less than the preset level, thereby compensating for the rectified voltage Vrec provided to the lighting unit 20.

The flicker control circuit 40 may perform the first discharge operation in response to the rectified voltage Vrec capable of controlling one or more LEDs or one or more LED groups to emit light. When it is supposed that the maximum charge voltage of the capacitor Cs included in the flicker control circuit 40 of FIG. 1 is equal to the light emission voltage V2 of the LED group LED2, the flicker control circuit 40 may perform the first discharge operation in response to the rectified voltage Vrec less than the light emission voltage V2 capable of controlling the LED groups LED1 and LED2 to emit light.

For this operation, the flicker control circuit 40 may include a first path element, a current circuit, a second path element, and a charge and discharge element.

The flicker control circuit 40 may include a diode D1 serving as the first path element, and the diode D1 may form a first path for the first charge operation in response to the rectified voltage Vrec equal to or more than a preset level, that is, the light emission voltage V2.

The current circuit may include an NPN transistor Q and a constant voltage source. The constant voltage source may include a Zener diode ZD. The Zener diode ZD may be formed between the capacitor Cs and the base of the NPN transistor Q. Thus, when the first path is formed by the diode D1, the NPN bipolar transistor Q may provide a magnitude-limited current to the capacitor Cs in response to a difference between the constant voltage of the Zener diode ZD and the base-emitter voltage of the NPN transistor Q. The resistor R2 may be formed between the base and collector of the NPN transistor Q, and the resistor R1 may be formed between the capacitor Cs and the emitter of the NPN transistor Q.

The flicker control circuit 40 may include the capacitor Cs serving as the charge and discharge element and a diode D2 serving as the second path element.

That is, when the first path is formed in response to the level change in rectified voltage of the input terminal of the lighting unit 20, the capacitor Cs may be charged through the first charge operation using the magnitude-limited current provided from the NPN transistor Q. Then, when the level of the rectified voltage of the input terminal of the lighting unit 20 becomes lower than the charge voltage of the capacitor Cs, the diode D2 may form a second path to perform the first discharge operation.

Through the above-described operation, the light emitting states of the LED groups LED1 and LED2 may be maintained because the voltage for compensating for the rectified voltage Vrec can be provided to the lighting unit 20 through the first discharge operation of the capacitor Cs when the rectified voltage Vrec is less than the light emission voltage V2. As a result, the currents I1 and I2 of the LED groups LED1 and LED2 of the lighting unit 20 may maintain a constant level.

When the rectified voltage Vrec is less than the light emission voltages V3 and V4, a small amount of current may be passed to the LED groups LED3 and LED4 by the charge voltage remaining in the capacitors C3 and C4. That is, when the rectified voltage Vrec is equal to or more than the light emission voltage V3, the capacitor C3 may be charged, and when the rectified voltage Vrec is equal to or more than the light emission voltage V4, the capacitors C3 and C4 may be charged. On the other hand, when the rectified voltage Vrec is less than the light emission voltage V4, the capacitor C4 may be discharged, and when the rectified voltage Vrec is less than the light emission voltage V3, the capacitors C3 and C4 may be discharged. Through the above-described process, the LED groups LED3 and LED4 may continuously maintain the light emitting state even though the light intensities thereof are changed.

As described above, the lighting apparatus in accordance with the embodiment of FIG. 1 can maintain constant brightness without turning off the LED groups LED1 and LED2, even when the rectified voltage Vrec is low. As a result, flicker can be reduced.

Furthermore, the lighting apparatus in accordance with the embodiment of FIG. 1 can perform the charge and discharge operation such that the LED groups LED1 and LED2 emit light at a relatively high light intensity using the capacitor having a small capacity. That is, flicker can be reduced through a simple part.

When the rectified voltage Vrec is equal or more than the light emission voltage V2, the capacitor Cs may be charged through the first charge operation of the flicker control circuit 40, and the LED groups LED1 and LED2 may maintain the light emitting state using the rectified voltage Vrec.

When the rectified voltage Vrec rises over the light emission voltages V3 and V4, the driving current flowing through the LED groups LED1 and LED2 may be regulated to a stepped waveform through the operation of the control unit 30.

While the rectified voltage Vrec rises over the light emission voltages V3 and V4, the LED groups LED3 and LED4 emit light, and the capacitors C3 and C4 may be charged.

As the above-described capacitors C3 and C4 are charged and discharged, the LED groups LED3 and LED4 may continuously maintain the light emitting state. As a result, flicker can be reduced.

The lighting apparatus in accordance with the embodiment of FIG. 1 may further include a charge control circuit 50 in order to improve a power factor. The charge control circuit 50 may include a transistor Qc and a diode Dc. The transistor Qc may control the amount of current stored in the capacitor Cs using the sensing voltage of the current sensing resistor Rs, and the diode Dc may be equivalently expressed in order to prevent a reverse current flow between the emitter and collector of the transistor Qc.

Figure 9:
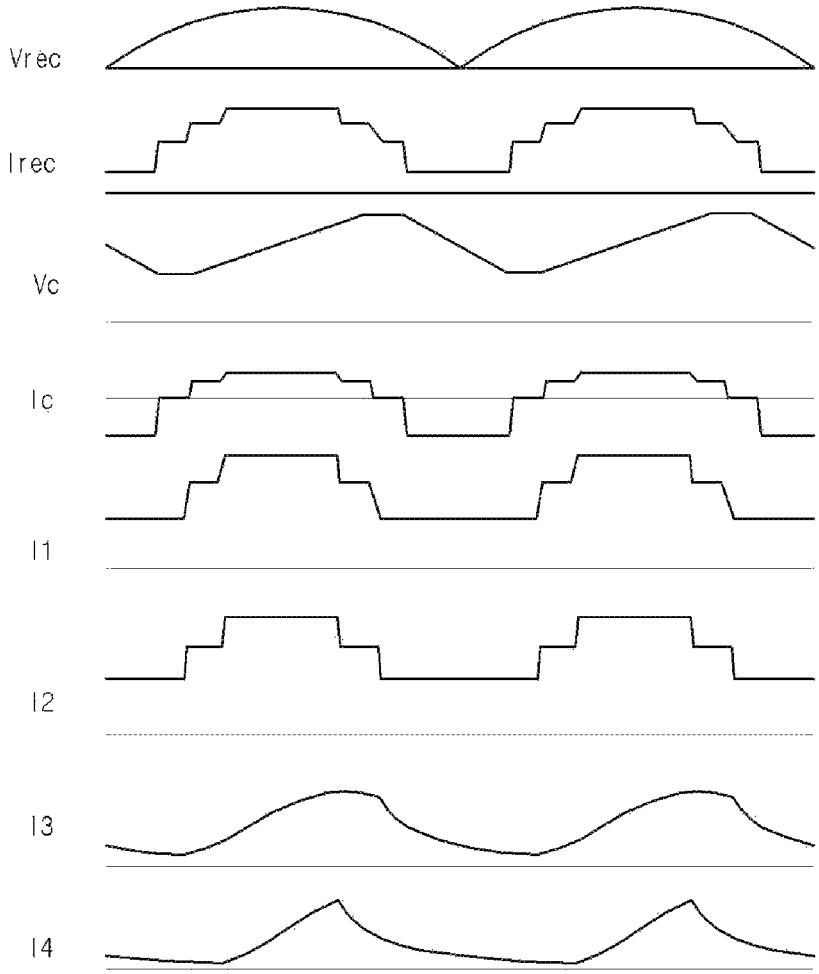
FIG. 9 is a waveform diagram for describing the operation of the lighting apparatus in accordance with the embodiment of FIG. 8.

The above-described charge control circuit 50 may control the amount of current supplied to charge the capacitor Cs such that the amount of current is proportional to the current amount of the current path formed by the control unit 30. Thus, when the rectified voltage Vrec rises over and falls below the light emission voltages V3 and V4, the amount of current supplied to charge the capacitor Cs may have a stepped waveform as illustrated in FIG. 9.

The above-described current control of the charge control circuit 50 can prevent a sudden change of current stored in the capacitor Cs, thereby improving the power factor.

Figure 5:
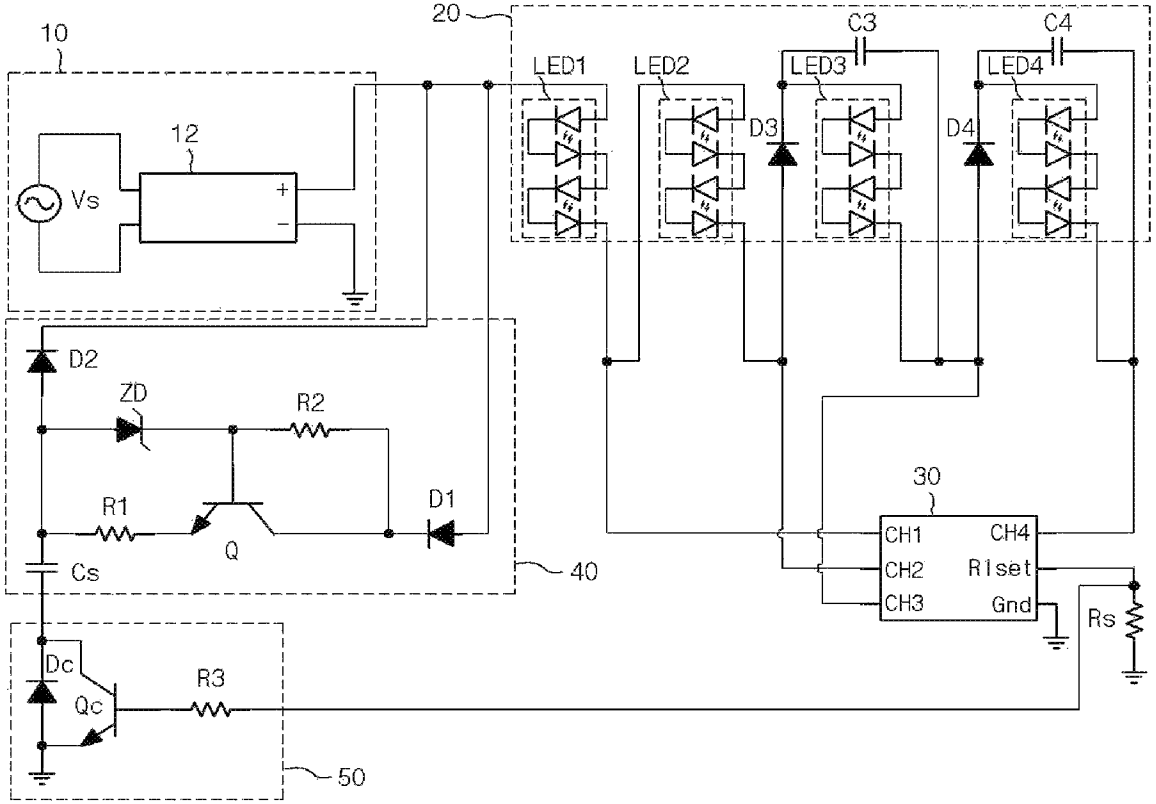
FIG. 5 is a circuit diagram illustrating a modified embodiment of FIG. 1.

FIGS. 1 and 5 illustrate that the charge operation and the discharge operation are applied to the same node, that is, the input terminal of the lighting unit 20.

Figure 6:
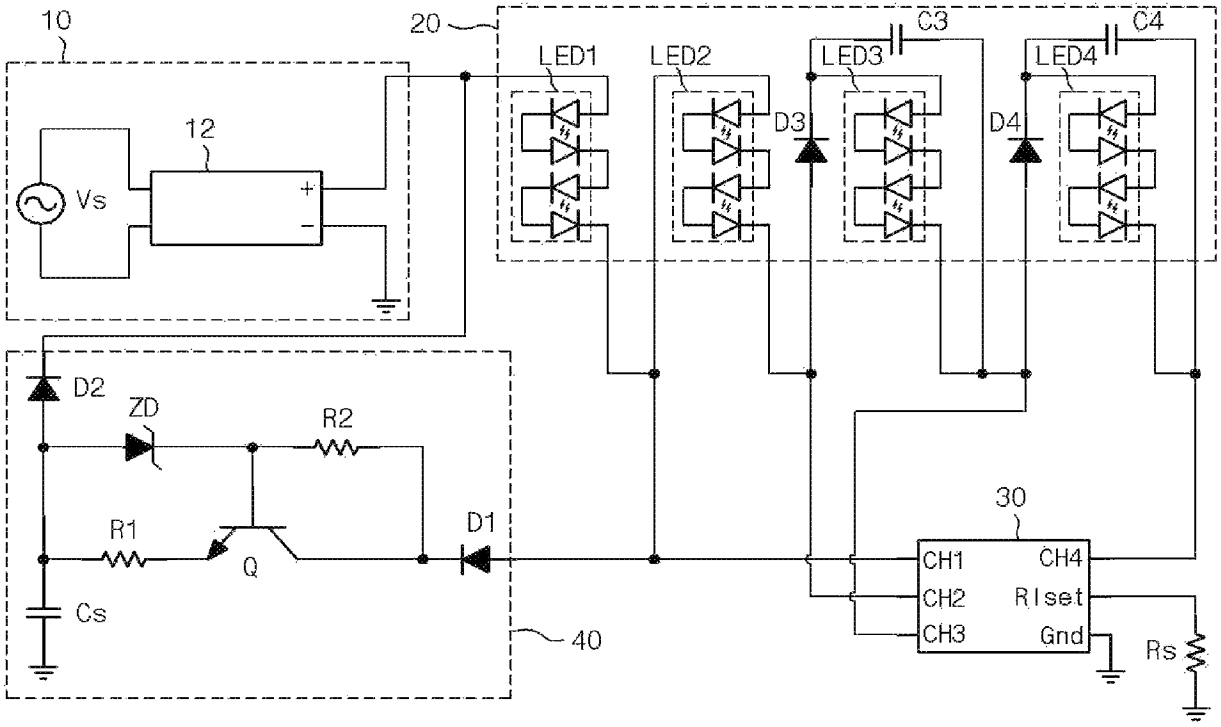
FIG. 6 is a circuit diagram illustrating a lighting apparatus in accordance with another embodiment of the present invention.

On the other hand, the lighting apparatus in accordance with the embodiment of the present invention may be configured in such a manner that the charge operation and the discharge operation are applied to different nodes as illustrated in FIG. 6. The embodiment of FIG. 6 may have the same configuration as the embodiment of FIG. 1, except that the diode D1 forming the first path of the flicker control circuit 40 is connected to a different node. Thus, the descriptions of the same configuration and operation as those of FIG. 1 are omitted herein.

In the embodiment of FIG. 6, the flicker control circuit 40 may secure a charge voltage Vc by performing a first charge operation based on a magnitude-limited current using a rectified voltage Vrec which is provided through one or more LEDs and equal to or more than a first level, and perform a first discharge operation to provide the charge voltage Vc to the input terminal of the lighting unit 20 in response to the rectified voltage Vrec less than a second level lower than the first level.

The flicker control circuit 40 may receive a rectified voltage for the first charge operation, the rectified voltage being equal to or more than a first level capable of controlling two or more LED groups to emit light. Furthermore, the flicker control circuit 40 may perform the first discharge operation in response to the rectified voltage less than a second level capable of controlling one or more LED groups to emit light.

In the embodiment of FIG. 6, the flicker control circuit may be configured in such a manner that the first level corresponds to the light emission voltage V3 and the second level corresponds to the light emission voltage V2.

Figure 7:
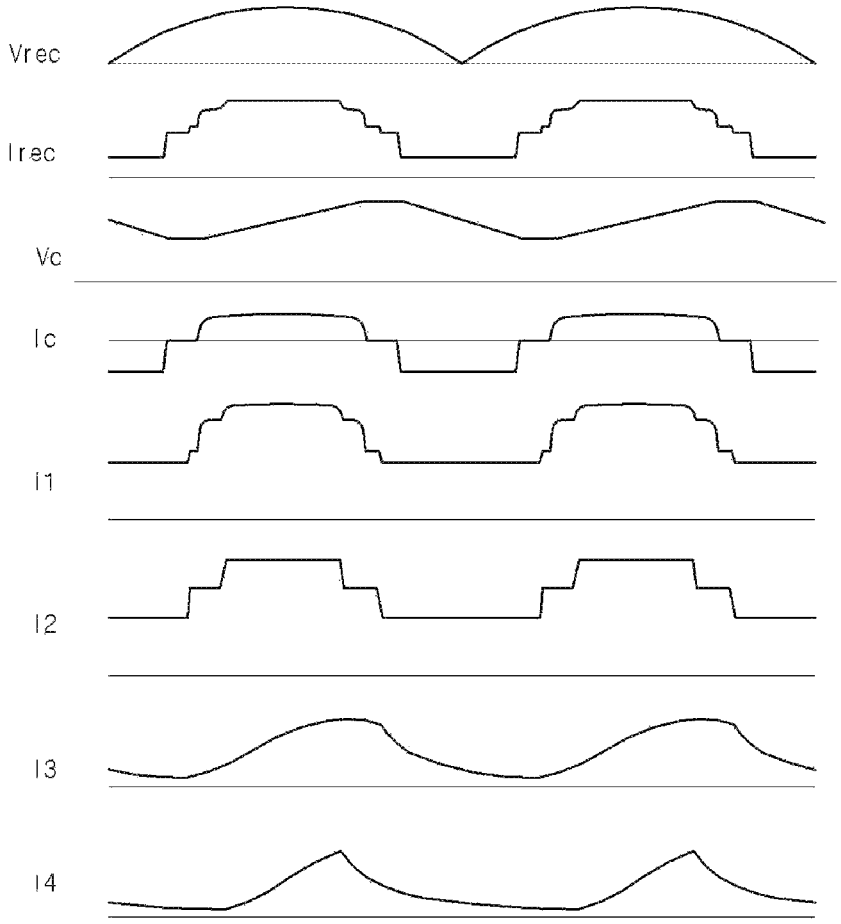
FIG. 7 is a waveform diagram for describing the operation of the lighting apparatus in accordance with the embodiment of FIG. 6.

That is, as illustrated in FIG. 7, the flicker control circuit 40 may perform the first discharge operation in response to the rectified voltage Vrec less than the light emission voltage V2 capable of controlling the LED group LED1 to emit light, and perform the first charge operation in response to the rectified voltage Vrec equal to or more than the light emission voltage V3 capable of controlling the LED group LED2 to emit light. The flicker control circuit 40 may stop the first charge or discharge operation in response to the rectified voltage Vrec between the light emission voltage V2 and the light emission voltage V3, and the charge voltage Vc may be maintained.

In the embodiment of FIG. 6, when the rectified voltage Vrec is less than the light emission voltage V2, the voltage for compensating for the rectified voltage Vrec may be provided to the lighting unit 20 through the first discharge operation for the capacitor Cs. Thus, the light emitting states of the LED groups LED1 and LED2 can be maintained. As a result, the currents I1 and I2 of the LED groups LED1 and LED2 of the lighting unit 20 may maintain a constant level.

When the rectified voltage Vrec is less than the light emission voltages V3 and V4, a small amount of current may be passed to the LED groups LED3 and LED4 by the charge voltage remaining in the capacitors C3 and C4.

That is, when the rectified voltage Vrec is equal to or more than the light emission voltage V3, the capacitor C3 may be charged, and when the rectified voltage Vrec is equal to or more than the light emission voltage V4, the capacitors C3 and C4 may be charged. On the other hand, when the rectified voltage Vrec is less than the light emission voltage V4, the capacitor C4 may be discharged, and when the rectified voltage Vrec is less than the light emission voltage V3, the capacitors C3 and C4 may be discharged. Through the above-described process, the LED groups LED3 and LED4 may continuously maintain the light emitting state even though the light intensities thereof are changed.

As described above, the lighting apparatus in accordance with the embodiment of FIG. 6 can maintain constant brightness without turning off the LED groups LED1 and LED2, even when the rectified voltage Vrec is low. As a result, flicker can be reduced.

Furthermore, the lighting apparatus in accordance with the embodiment of FIG. 6 can perform the charge and discharge operation such that the LED group LED1 emits light at a relatively high light intensity using the capacitor Cs having a small capacity. That is, flicker can be reduced through a simple part.

When the rectified voltage Vrec is equal or more than the light emission voltage V3, the capacitor Cs may be charged through the first charge operation of the flicker control circuit 40, and the LED groups LED1 and LED2 may maintain the light emitting state using the rectified voltage Vrec.

When the rectified voltage Vrec rises over the light emission voltages V3 and V4, the current flowing to the LED groups LED1 and LED2 may be regulated to a stepped waveform through the operation of the control unit 30.

While the rectified voltage Vrec rises over the light emission voltages V3 and V4, the LED groups LED3 and LED4 may emit light, and the capacitors C3 and C4 may be charged.

That is, when the rectified voltage Vrec is equal to or more than the light emission voltage V3, the capacitor C3 may be charged, and when the rectified voltage Vrec is equal to or more than the light emission voltage V4, the capacitors C3 and C4 may be charged. On the other hand, when the rectified voltage Vrec is less than the light emission voltage V4, the capacitor C4 may be discharged, and when the rectified voltage Vrec is less than the light emission voltage V3, the capacitors C3 and C4 may be discharged. Through the above-described process, the LED groups LED3 and LED4 may continuously maintain the light emitting state, even though the light intensities thereof are changed.

As the capacitors C3 and C4 are discharged, flicker can be reduced.

Figure 8:
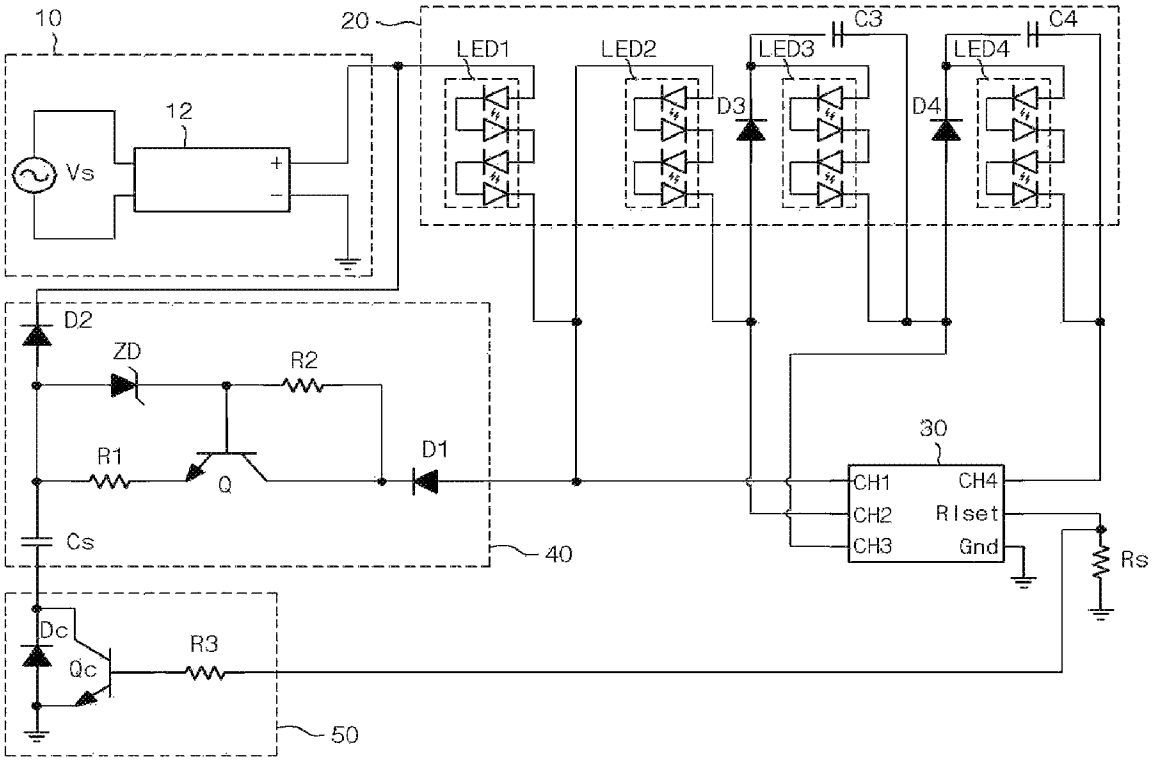
FIG. 8 is a circuit diagram illustrating a modified embodiment of FIG. 6.

The lighting apparatus in accordance with the embodiment of FIG. 6 may further include a charge control circuit 50 illustrated in FIG. 8, in order to improve a power factor. Since the charge control circuit 50 is configured and operated in the same manner as FIG. 5, the duplicated descriptions thereof are omitted herein.

The charge control circuit 50 of FIG. 8 may also control the amount of current supplied to charge the capacitor Cs such that the amount of current is proportional to the current amount of the current path formed by the control unit 30. Thus, when the rectified voltage Vrec rises over and falls below the light emission voltages V3 and V4, the amount of current supplied to charge the capacitor Cs may have a stepped waveform as illustrated in FIG. 9.

The above-described current control of the charge control circuit 50 can prevent a sudden change of the current stored in the capacitor Cs, thereby improving the power factor.

Figure 10:
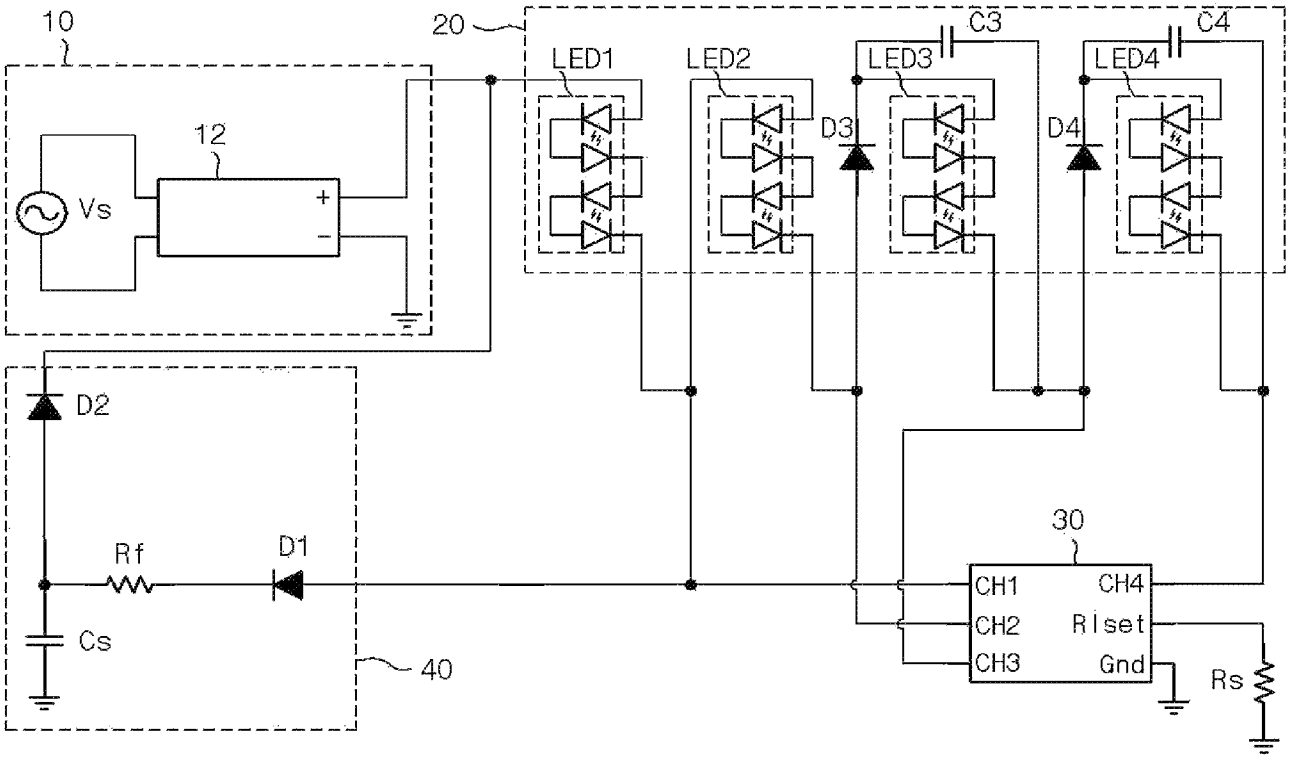
FIG. 10 is a circuit diagram illustrating a lighting apparatus in accordance with another embodiment of the present invention.

In the embodiment of FIG. 6, the flicker control circuit 40 may be modified as illustrated in FIG. 10, in order to simplify the configuration. The flicker control circuit 40 may include a resistor Rf serving as a current circuit. Since the other components of the embodiment of FIG. 10 have the same configuration as the embodiment of FIG. 6, the detailed descriptions thereof are omitted herein. Furthermore, since the embodiment of FIG. 10 is operated in substantially the same manner as the embodiment of FIG. 6, the detailed descriptions thereof are omitted herein.

As described above, the configuration for the charge and discharge operation for reducing flicker may be applied in a different manner depending on the light intensities of the LEDs.

Thus, since the capacitors for reducing flicker do not need to be applied to the entire LED groups, the number of capacitors can be minimized. Since a small number of capacitors are used to reduce flicker, the manufacturing cost can be reduced, and the use of a printed circuit board having parts mounted thereon can be improved.

In accordance with the embodiments of the present invention, the lighting apparatus can reduce flicker by charging and discharge the capacitor having a small capacity with the rectified voltage, and reduce flicker using a small number of simple parts.

Furthermore, the lighting apparatus may perform the charge and discharge operation using the rectified voltage on the LEDs having a relatively high light intensity, and perform the charge and discharge operations on the respective LEDs having a relatively low light intensity, thereby reducing flicker.

Furthermore, the lighting apparatus may control the charge operation to follow the current of the LED current path in response to light emission of the LEDs having a relatively low light intensity, thereby improving a power factor.

While various embodiments have been described above, it will be understood to those skilled in the art that the embodiments described are by way of example only. Accordingly, the disclosure described herein should not be limited based on the described embodiments.

What is claimed is:

1. A lighting apparatus which uses a rectified voltage, comprising:

a lighting unit comprising a plurality of LEDs configured to emit light in response to the rectified voltage and divided into a plurality of LED groups;

a flicker control circuit configured to secure a charge voltage by performing a first charge operation based on a magnitude-limited current using the rectified voltage which is equal to or more than a first level and provided through one or more LEDs, and provide the charge voltage to an input terminal of the lighting unit through a first discharge operation, in response to the rectified voltage less than a second level lower than the first level; and a control unit configured to provide a current path for light emission of the lighting unit, wherein the lighting unit comprises one or more capacitors connected in parallel to the respective LED groups and configured to perform a second charge or discharge operation, wherein the flicker control circuit comprises:

a first path element configured to form a first path for the first charge operation in response to the rectified voltage which is equal to or more than the first level and provided through one or more LEDs;

a current circuit configured to provide a current when the current is introduced through the first element;

a second path element configured to form a second path for the first discharge operation in response to the rectified voltage less than the second level; and a charge and element configured to perform the first charge operation using the current and perform the first discharge operation through the second path.

2. The lighting apparatus of claim 1, wherein the flicker control circuit performs the first charge operation in response to the rectified voltage equal to or more than the first level at which one or more LED groups emit light.

3. The lighting apparatus of claim 1, wherein the flicker control circuit performs the first discharge operation in response to the rectified voltage less than a second level at which one or more LED groups emit light.

4. The lighting apparatus of claim 1, wherein the current circuit comprises:

an NPN bipolar transistor configured to provide a current to the charge and discharge element in response to the formation of the first path; and a constant voltage source configured to form a constant voltage at the base of the NPN bipolar transistor in response to the formation of the first path, and the NPN bipolar transistor provides the current for the first charge operation to the charge and discharge element in response to the constant voltage.

5. The lighting apparatus of claim 1, wherein the current circuit comprises a resistor configured to connect the first path element and the charge and discharge element.

6. The lighting apparatus of claim 1, further comprising a charge control circuit configured to control the amount of current supplied for the first discharge operation such that the amount of current is proportional to the change in current amount of the current path for light emission of the lighting unit.

7. The lighting apparatus of claim 1, wherein the capacitor is configured in the one or more LED groups which emit light in response to the rectified voltage equal to or more than the first level.

8. A lighting apparatus which uses a rectified voltage, comprising:

a lighting unit comprising a plurality of LEDs configured to emit light in response to the rectified voltage and divided into a plurality of LED groups;

a flicker control circuit configured to secure a charge voltage by performing a first charge operation using a current corresponding to the rectified voltage equal to or more than a preset level, and compensate for the rectified voltage provided to the lighting unit by performing a first discharge operation for the charge voltage in response to the rectified voltage less than the preset level; and a control unit configured to provide a current path for light emission of the lighting unit, wherein the lighting unit comprises one or more capacitors connected in parallel to the respective LED groups and configured to perform a second discharge or charge operation, wherein the flicker control circuit comprises:

a first path element configured to form a first path for the first charge operation in response to the rectified voltage equal to or more than the preset level;

a current circuit configured to provide a current when the current is introduced through the first path element;

a second path element configured to form a second path for the first discharge operation in response to the rectified voltage less than the preset level; and a charge and discharge element configured to perform the first charge operation using the current and perform the first discharge operation through the second path.

9. The lighting apparatus of claim 8, wherein the flicker control circuit performs the first discharge operation in response to the rectified voltage lower than a level at which one or more LEDs or one or more LED groups emit light.

10. The lighting apparatus of claim 8, wherein the current circuit comprises:

an NPN bipolar transistor configured to provide a current to the charge and discharge element in response to the formation of the first path; and a constant voltage source configured to form a constant voltage at the base of the NPN bipolar transistor in response to the formation of the first path, and the NPN bipolar transistor provides the current for the first charge operation to the charge and discharge element in response to the constant voltage.

11. The lighting apparatus of claim 8, further comprising a charge control circuit configured to control the amount of current supplied for the first charge operation such that the amount of current is proportional to the change in current amount of the current path for light emission of the lighting unit.

12. The lighting apparatus of claim 8, wherein the capacitor is configured in the one or more LED groups which emit light in response to the rectified voltage equal to or more than the first level.

* * * * *